US007086877B1

(12) United States Patent
Abbott

(10) Patent No.: US 7,086,877 B1
(45) Date of Patent: Aug. 8, 2006

(54) TERMINATOR LOCKING COVER SYSTEM

(76) Inventor: Phillip G. Abbott, 819 Mimosa Heights Dr., Louisville, TN (US) 37777

( * ) Notice: Subject to any disclaimer, the term of this patent is extended or adjusted under 35 U.S.C. 154(b) by 0 days.

(21) Appl. No.: 11/186,050

(22) Filed: Jul. 21, 2005

(51) Int. Cl.
*H01R 13/44* (2006.01)

(52) U.S. Cl. ..... 439/133; 439/307

(58) Field of Classification Search ..... 439/131–134, 439/307
See application file for complete search history.

(56) References Cited

U.S. PATENT DOCUMENTS 3,027,535 A * 3/1962 Persson ..... 439/360
3,519,979 A * 7/1970 Bodenstein ..... 439/133
4,824,386 A * 4/1989 Souders ..... 439/133
4,932,874 A * 6/1990 Hollopeter et al. ..... 439/133
5,106,312 A * 4/1992 Yeh ..... 439/133
5,395,348 A * 3/1995 Ryan ..... 604/247
5,435,736 A * 7/1995 McMills et al. ..... 439/133

* cited by examiner

*Primary Examiner*—Michael C. Zarroli
(74) *Attorney, Agent, or Firm*—Pitts & Brittian, P.C.

(57) ABSTRACT

A terminal locking system comprises an elongated tubular case having a connection end section and an opposing protection end section, an adapter configured to matingly engage a terminal rotatably mounted within the connection end section, a blocker mounted within the tubular case, at least a portion of the blocker being rotatable within the case, and a cap secured to the rotatable portion of said blocker.

9 Claims, 4 Drawing Sheets

TERMINATOR LOCKING COVER SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to caps for radio frequency terminators having threaded connectors.

More particularly, this invention pertains to a tamper-proof locking device and related tools for locking and unlocking the device.

2. Description of the Related Art

In the field of radio frequency signal distribution over a conducting cable, for example cable television, an incoming cable, called a "drop," is generally threadably connected to a terminal or splitter from which the signal is then distributed to a plurality of locations. There are times when the incoming cable must be terminated in a manner that prevents accessibility to the signal carried on the cable. This may occur when a cable system is installed, before a licensed user is available to use the signal. Alternatively, it may be necessary when a licensed user fails to make payments to the signal provider so that service must be terminated.

In the prior art, a 75 ohm resistor adapter having a male connector and a female connector is threadably attached to the terminal using the female connector and the drop is threadably connected to the male connector. The resistor prevents communication of the signal to the terminal. However, because unlicensed users have removed the resistor adapters without permission, in order to use the service without payment, the resistor adapters have been modified to resist removal without a particular tool.

In one prior art device, the female connector is rotatably mounted within a sleeve that includes the male connector. Thus, when the resistor adapter is tightly secured to the terminal, the sleeve rotates freely and the adapter is not readily removable from the terminal.

The male connector is tubular in shape to allow insertion of a tool comprising a female connector adapted to threadably engage the male connector of the resistor adapter and an axial extension. By tightening the engagement of the female connector of the tool with the male connector of the resistor adapter, the axial extension of the tool extends through the sleeve to frictionally engage the smooth outer surface of the female connector and prevent rotation of the female connector relative to the sleeve. In this condition, with the tool securely attached, the resistor adapter can be either attached or removed from the terminal.

Unfortunately, there are still users who have found methods for improperly removing the resistor adapters in order to acquire unauthorized access to the signal carried on the drop cable. For example, some users use a nail or drill to pierce the female connector of the resistor adapter and thereby control the rotation of the female connector and remove it from the terminal.

Accordingly there remains a need to prevent the unauthorized removal of resistor adapters from radio frequency terminals.

BRIEF SUMMARY OF THE INVENTION

According to one embodiment of the present invention, a system is provided for preventing unauthorized removal of resistor adapters from radio frequency terminals. Generally, a resistor adapter, including a female connector rotatably mounted within a sleeve including an opposing coaxial male connector, is secured within a tubular case having an inner diameter. The sleeve is secured within the tubular case to prevent rotation of the sleeve relative to the case. Preferably, the tubular case is constructed from hardened steel to prevent easy destruction, by cutting, for example. The case is cylindrically tubular to allow insertion of a first blocker tool comprising a female connector adapted to threadably engage the male connector of the resistor adapter.

An elongated blocker, having a female end section and an opposing male end section is mounted within the case to prevent access to the female connector of the resistor adapter through the case. The female end section is rotatable relative to the male end section and coaxial therewith. The female end section includes a non-cylindrical exterior shoulder. The width of the blocker is less than the inner diameter of the case to permit insertion of a first blocker tool to engage the non-cylindrical shoulder of the female end section and rotate the female end section relative to the male connector of the resistor adapter.

An extension portion of the male end section extends longitudinally from the case. The extension portion includes a non circular engagement surface adapted to be engaged by a second blocker tool. The distal end of the male end section of the blocker is preferably conically shaped and constructed from hardened steel to prevent damage or removal to gain access to the female end section. An elongated cap, preferably comprising hardened steel, includes a female connector and an opposing male connector. The female connector of the cap is threadably connectible to the male end section of the blocker.

In this embodiment, spacer lugs are included in the end wall of the case to prevent complete engagement of the case and the cap. The spacer lugs permit insertion of a second blocker tool between the case and the cap to engage the engagement surface of the male end section of the blocker and prevent rotation of the male end section of the blocker while the cap is threadably attached to or removed from the blocker.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
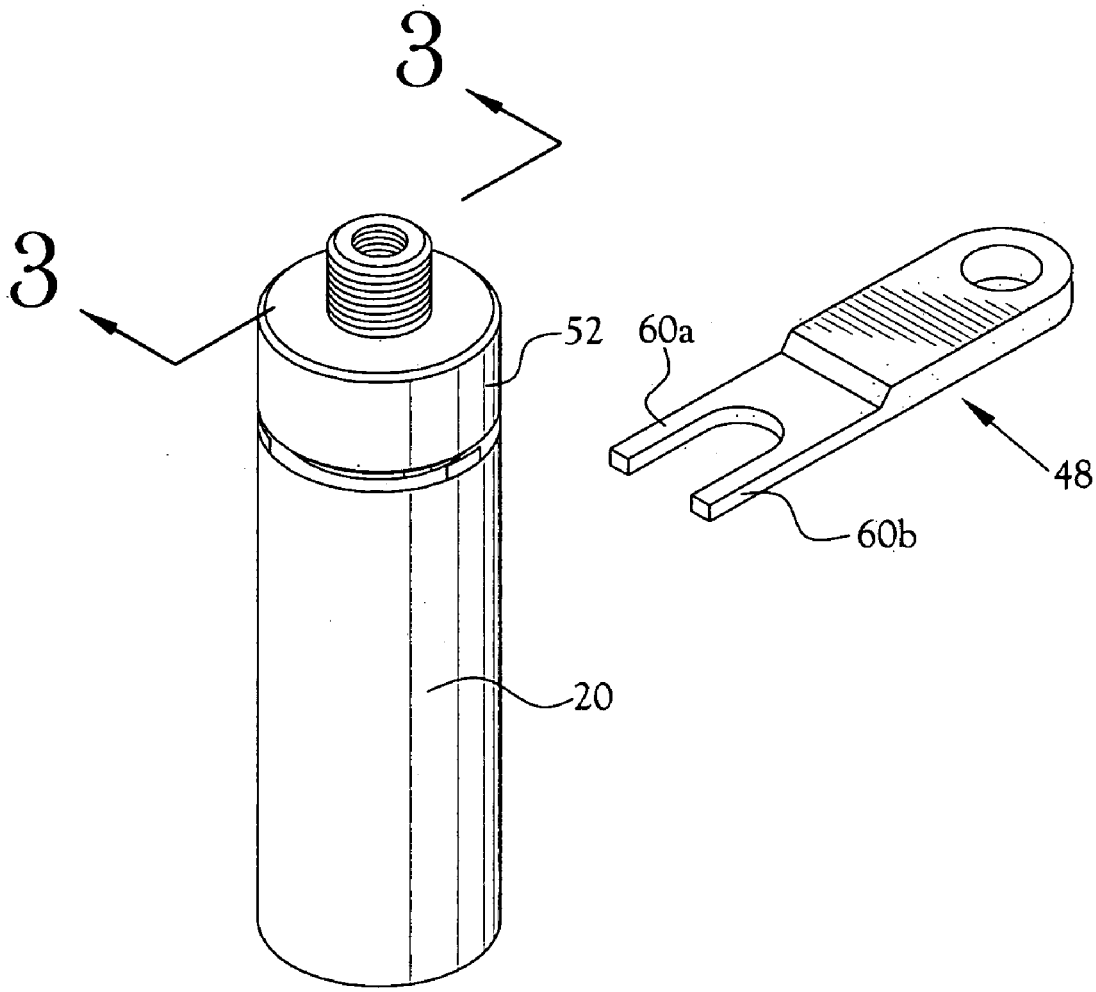
FIG. 1 is a perspective view of an embodiment of a terminator locking system in accordance with the present invention.
Figure 2:
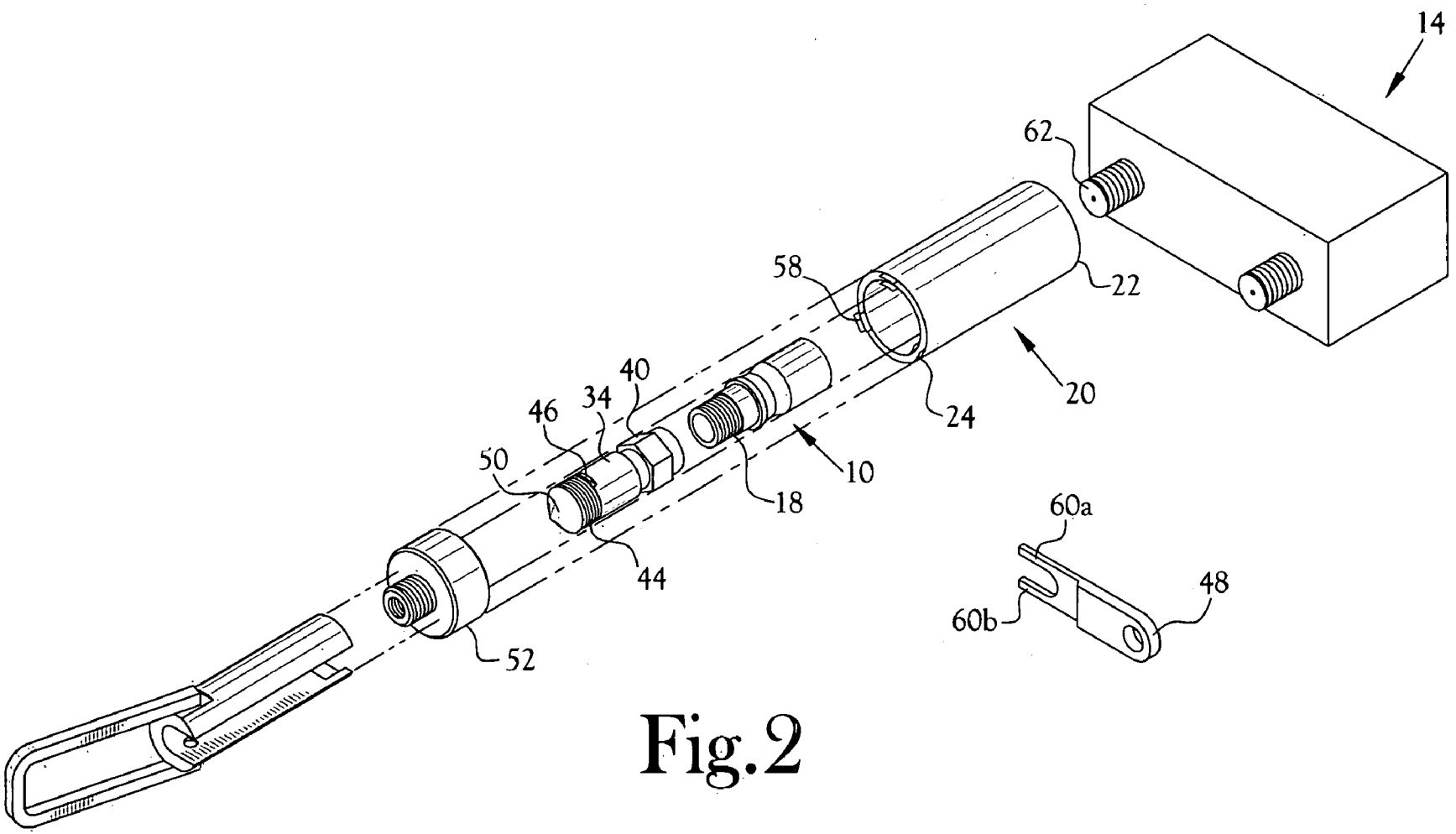
FIG. 2 is an exploded perspective view of the embodiment shown in FIG. 1.
Figure 3:
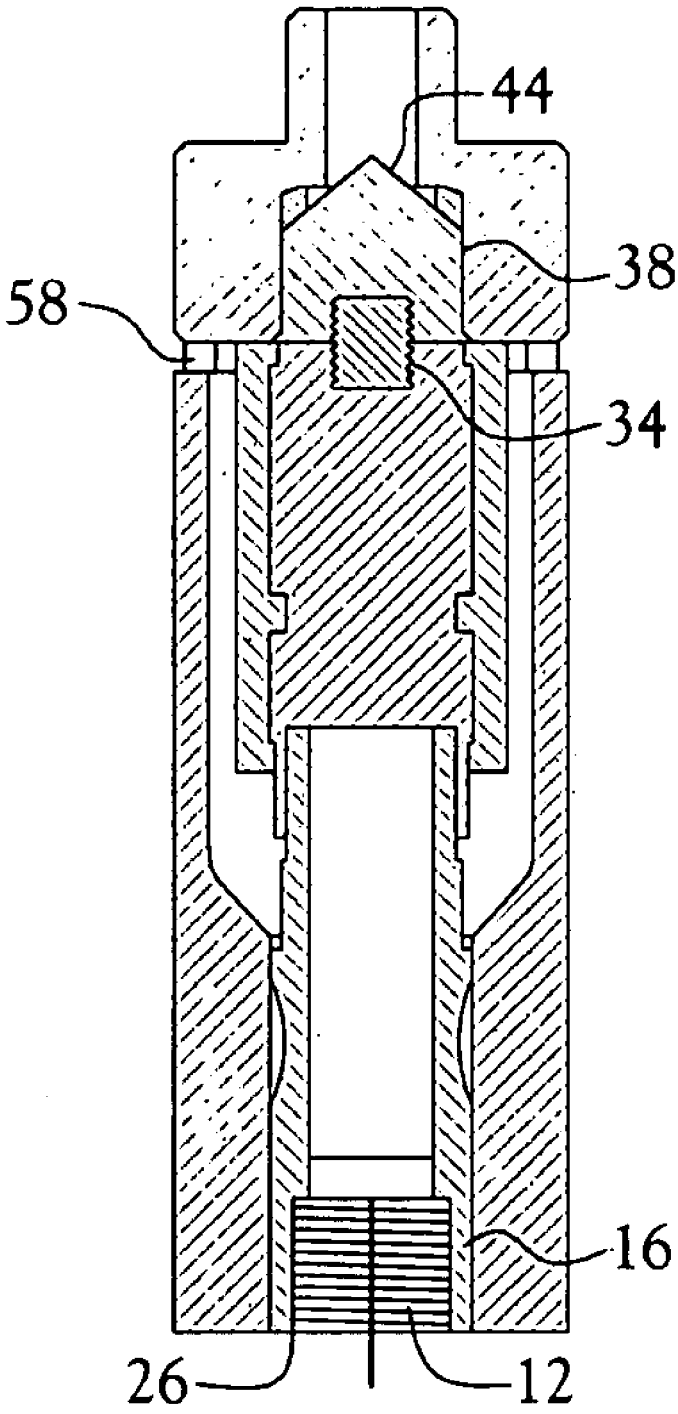
FIG. 3 is a sectional elevation view of the embodiment shown in FIG. 1.

Referring to the drawings, in which similarly numbered items represent similar items, a system, including a protective cover for a resistor adapter and tools for assembling and disassembling the cover, is disclosed.

Generally, a resistor adapter 10, including a female connector 12 adapted for mating engagement with a terminal is rotatably mounted within a sleeve 16 including an opposing coaxial male connector 18, is secured within an elongated tubular case 20 having an inner diameter. The tubular case 20 includes a connection end 22 and a protection end 24. The distal end 26 of the female connector 12 is generally coplanar with the connection end of the case 20 so that when the female adapter 12 is fully engaged with the terminal 14 it is fully surrounded by the case 20 and the terminal 14. The sleeve 16 is secured within the tubular case by a pressure fit to prevent rotation of the sleeve 16 relative to the case 20. Other means may be used to prevent rotation of the sleeve 16 relative to the case 20. Preferably, the tubular case 20 is constructed from hardened steel to prevent easy destruction, by cutting, for example.

The case 20 is cylindrically tubular to allow insertion of a first end 28 of an elongated first blocker tool 30. The first end 28 is tubular and threaded to matingly engage the male connector 18 of the resistor adapter 110. An axial extension 32 extends beyond the first end 28 so that, when the first end 29 is fully engaged with the male connector 18, the extension makes pressurized contact with the female adapter 12. In this manner the female adapter 12 is ratable for attachment and removal from the terminal 14.

A removable elongated blocker 34, having a female end section 36 and an opposing male end section 38 is mounted within the case to prevent access to the female connector 12 of the resistor adapter 10 through the case 20. The female end section 36 is rotatable relative to the male end section 38 and coaxial therewith. The female end section 36 includes a non-cylindrical exterior shoulder. 40. The diameter of the blocker 34 is less than the inner diameter of the case 20 to permit insertion of a second end 42 of the first blocker-tool 30 to engage the non-cylindrical shoulder 42 of the female end section 36 and rotate the female end section 36 relative to the male connector 18 of the resistor adapter 10.

An extension portion 44 of the male end section 38 extends longitudinally from the case 20 when the female end section 36 is fully engaged with the male connector 18. The extension portion 44 includes a non circular engagement surface 46, adapted to be engaged by a second blocker tool 48. The distal end 50 of the male end section 38 of the blocker 34 is preferably conically shaped and constructed from hardened steel to prevent damage or removal to gain access to the female end section 36.

An elongated cap 52, preferably comprising hardened steel, includes a female end section 54 and an opposing male end section 56. The female end section 54 of the cap 52 is threaded for mating connection to the male end section 38 of the blocker 34. The male end section 56 of the cap 52 is threaded for mating engagement with a coaxial cable transmitting a signal from the terminal to an end user.

In this embodiment, spacer lugs 58 are included in the protection end of the case 20 to prevent complete engagement of the protection end 24 of the sleeve 20 sleeve and the cap 52 when they are matingly engaged. The spacer lugs permit insertion of two parallel tines 60*a* and 60*b* of the second blocker tool 48 between the case 20 and the cap 52 to engage the engagement surface 46 of the male end section 38 of the blocker 34 and prevent rotation of the male end section of the blocker while the cap 52 is threadably attached to or removed from the blocker.

In operation, a cable for which service is being terminated is removed from the terminal 14, exposing the male connector 62. The first end 28 of the first blocker tool 30 is inserted into the case 20 and rotated to threadably engage the male connector 18 of the resistor adapter 10. Upon full mating engagement of the first end 28 with the male connector 18, the axial extension provides sufficient pressure against the female adapter 12 to prevent rotation of the female adapter 12 relative to the male connector 18 and the female adapter is threadably mounted upon the male connector of the terminal 14 and tightened until the connection end 22 of the case 20 contacts the terminal 14. The first blocker tool 30 is then unthreaded from the male connector 18 and removed from the case 20. At this point, the female adapter 12 is securely attached to the male connector 62 of the terminal 14 and the case 20 is freely rotatable relative to the female adapter 12.

The female end section 36 of the blocker 34 is inserted into the case 20 and threaded onto the male connector 18. The second end 42 of the first blocker tool 30 matingly engages the shoulder 40 so that rotation of the first blocker tool 30 tightens the engagement between the male connector 18 and the female end section 36 of the blocker 34. At this point, the case 20 is freely rotatable relative to both the female adapter 12 and the male end section 38 of the blocker 34.

The female end section 54 of the cap 52 is then attached to the blocker by threading onto the male end section 38 of the blocker 34. The tines 60*a* and 60*b* of the second blocker tool 48 are then inserted between the space lugs 58 to engage the non-circular engagement surface 46 and prevent rotation of the male end section 38 while the cap is tightened onto the male section 38. The tightening may be accomplished by re-attaching the service cable to the male end section 56 of the cap 52, for example. Then the second blocker tool is withdrawn. At this point, the case 20 is freely rotatable relative to the female adapter 12 and the cap 52 is freely rotatable relative to the case 20. Without access to the first blocker tool 28 and the second blocker tool 48, the end-user cannot remove the female adapter from the terminal 14.

The terminator locking cover is removable by reversing the steps of operation described hereinabove.

Figure 4:
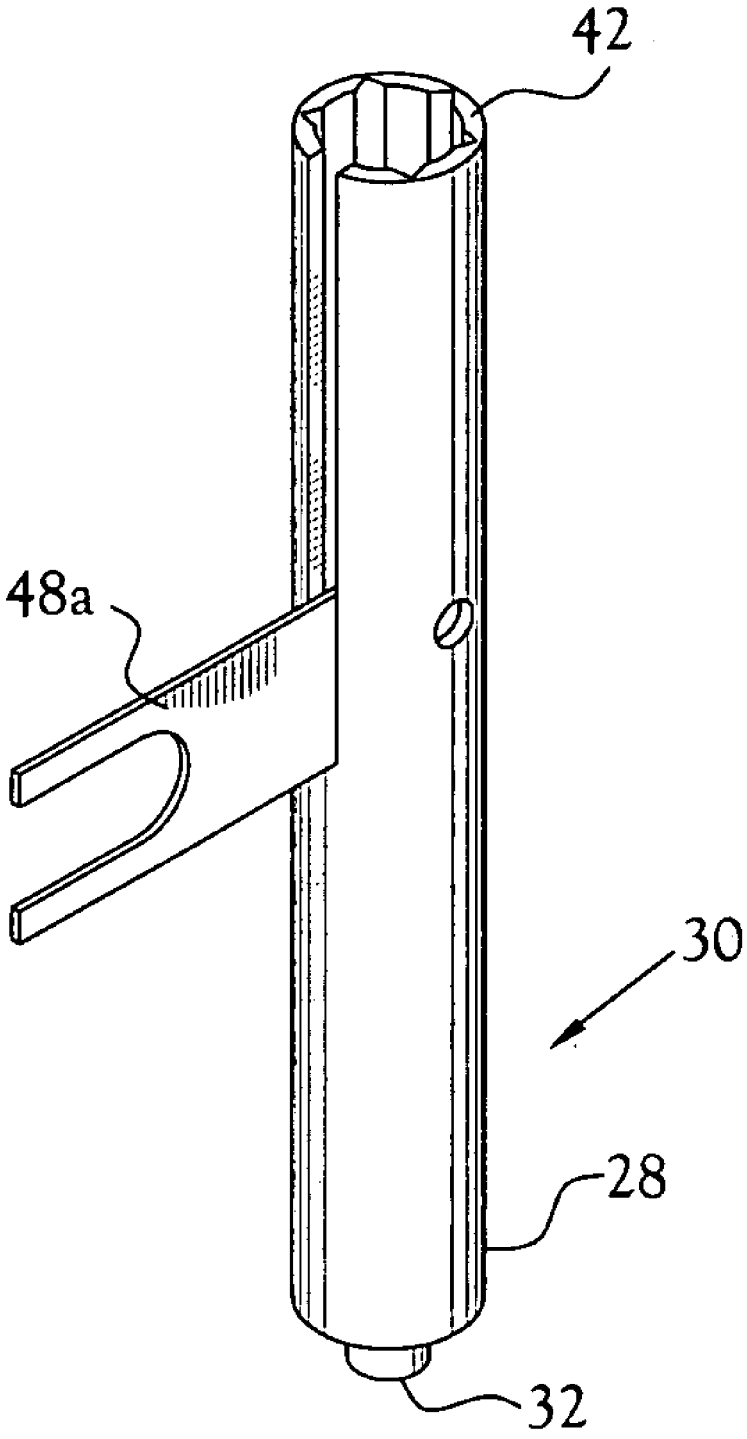
FIG. 4 is a perspective view of a combination tool for assembling and dismantling a terminator lock.

Those skilled in the art will recognize that various modifications of the system can be used without departing from the spirit and scope of the present invention. For example, FIG. 4 illustrates a combined blocker tool wherein the second blocker tool 48 is pivotally mounted upon the first blocker tool 30.

From the foregoing description, it will be recognized by those skilled in the art that an improved terminal locking system has been has been provided.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A terminal locking system comprising:

an elongated tubular case having a connection end section and an opposing protection end section, an adapter configured to matingly engage a terminal rotatably mounted within said connection end section, a blocker mounted within said tubular case, at least a portion of said blocker being rotatable within said case, and a cap secured to said rotatable portion of said blocker.

2. The apparatus of claim 1 wherein said case is cylindrical and defines an inner wall having an inner diameter.

3. The apparatus of claim 2 wherein, said blocker includes a non-circular shoulder and said blocker has a diameter less than said inner diameter, whereby a tool is insertable between said blocker and said inner wall to engage said shoulder and secure a portion of said blocker to said adapter.

4. The apparatus of claim 1 wherein said cap includes an end section adapted to matingly engage a service cable.

5. The apparatus of claim 1 wherein said adapter includes a male end section adapted to matingly engage a female end section of said blocker.

6. The apparatus of claim 1 wherein said protection end of said case includes one or more lugs to maintain a gap between said case and said cap when said cap is fully engaged with said blocker.

7. The apparatus of claim 6 wherein said rotatable portion of said blocker includes a non-circular engagement surface located adjacent to said gap, whereby a tool may be inserted through said gap to engage said engagement surface and prevent rotation of said rotatable portion during attachment or removal of said cap.

8. The apparatus of claim 1 wherein said blocker comprises a female end section and an opposed male end section, said female end section and said male end section being attached and rotatable relative to each other.

9. The apparatus of claim 1 wherein said rotatable portion of said blocker includes a conical section adjacent to said cap.

* * * * *